US007267341B2

(12) United States Patent
Shah

(10) Patent No.: US 7,267,341 B2
(45) Date of Patent: Sep. 11, 2007

(54) WORD TRAVELS

(76) Inventor: Kashan Shah, 11135-23 A Avenue, Edmonton, Alberta (CA) T6J 4W5

( * ) Notice: Subject to any disclaimer, the term of this patent is extended or adjusted under 35 U.S.C. 154(b) by 0 days.

(21) Appl. No.: 11/435,914

(22) Filed: May 17, 2006

(65) Prior Publication Data

US 2006/0261555 A1 Nov. 23, 2006

Related U.S. Application Data

(60) Provisional application No. 60/681,878, filed on May 17, 2005.

(51) Int. Cl.
*A63F 9/22* (2006.01)

(52) U.S. Cl. ..... 273/272

(58) Field of Classification Search ..... 273/272, 273/299; 434/170, 171, 172
See application file for complete search history.

(56) References Cited

U.S. PATENT DOCUMENTS 4,789,162 A * 12/1988 Harris ..... 273/272
5,860,653 A * 1/1999 Jacobs ..... 273/272
6,116,604 A * 9/2000 Vandelli ..... 273/272
6,769,692 B1 * 8/2004 Cavalluzzo ..... 273/272

OTHER PUBLICATIONS

Gamehouse, Text twist, Available at http://www.gamehouse.com/onlinegames/playgame.jsp?navnum=9&AID=&game=twist&code=TextTwist, at least as early as 2003.

* cited by examiner

*Primary Examiner*—William M. Pierce
(74) *Attorney, Agent, or Firm*—Davis Bujold & Daniels, P.L.L.C.

(57) ABSTRACT

A method of playing a game. More than one tableau spaces are provided, and a group of letters are provided arranged in a random sequence corresponding to each tableau space, wherein the letters available for play are the endmost letters. Words or beginning of words are formed by rearranging the endmost letters of the sequences, wherein the words or beginning of words are formed by the endmost letters of each sequence such that the last letter of the sequence is the last letter of the word or the last letter of the beginning of the word, and wherein the endmost letter of a sequence may be moved onto the endmost letter of another sequence if a word or the beginning of a word is formed on the other sequence, or more than one of the endmost letters may be moved onto the endmost letter of another sequence if the endmost letters are the beginning of a word or if a word or the beginning of a word is formed on the other sequence. Words formed from the endmost letters of the sequences are removed.

13 Claims, 8 Drawing Sheets

WORD TRAVELS

This application claims priority from U.S. Provisional Application Ser. No. 60/681,878 filed May 17, 2005.

FIELD OF THE INVENTION

The present application relates to a game where the objective is to form words of letters.

BACKGROUND OF THE INVENTION

Some card games, such as many of the types of solitaire, require a player to group cards together in a specific order. There are also letter games which require the player to combine letters to form words in order to score points.

SUMMARY OF THE INVENTION

There is provided a method of playing a game. The game is played by providing more than one tableau spaces and a group of letters arranged in a random sequence corresponding to each tableau space, wherein the letters available for play are the endmost letters words or beginning of words are formed by rearranging the endmost letters of the sequences, wherein the words or beginning of words are formed by the endmost letters of each sequence such that the last letter of the sequence is the last letter of the word or the last letter of the beginning of the word, wherein the endmost letter of a sequence may be moved onto the endmost letter of another sequence if a word or the beginning of a word is formed on the other sequence, or more than one of the endmost letters may be moved onto the endmost letter of another sequence if the endmost letters are the beginning of a word or if a word or the beginning of a word is formed on the other sequence. Words formed from the endmost letters of the sequences are removed.

According to another aspect, the method of playing a game comprises the steps of providing at least one tableau space and providing a group of letters arranged in a random sequence corresponding to each tableau space, wherein the letters available for play are the endmost letters. Foundation spaces are provided. A reserve of letters are provided that are dealt out onto the foundation spaces as needed. Words are formed by arranging the letters dealt from the reserve of letters and the endmost letters of the at least one sequence into words in the foundation spaces using the letters from the reserve of letters.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION OF THE INVENTION

The method of playing a letter game will now be described with reference to FIGS. 1 through 7.

Figure 1:
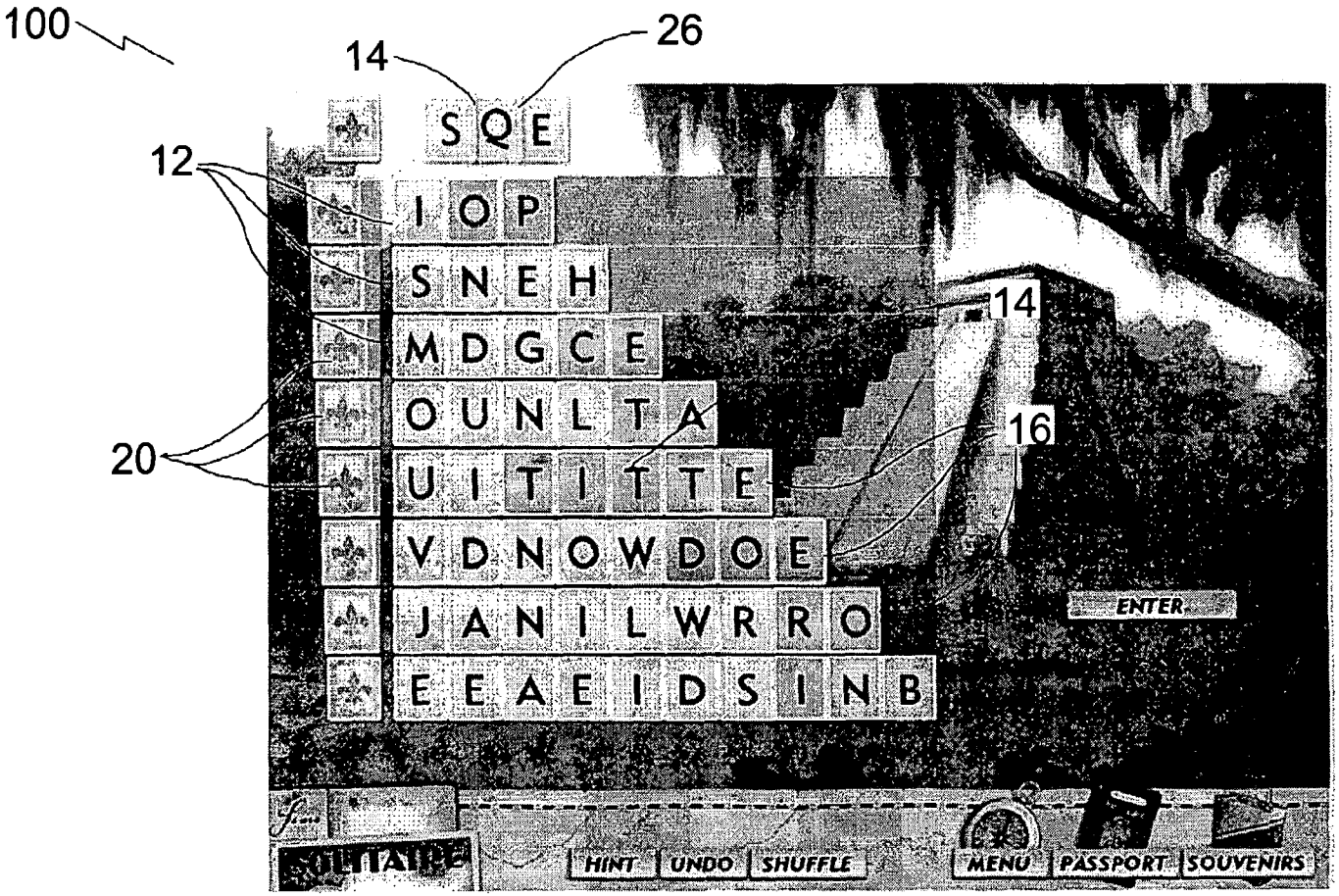
FIG. 1 is a klondike solitaire style layout of the letter card game.

Referring to FIG. 1, the game is played by providing more than one tableau space 12, and providing a group of letters 14 arranged in a random sequence 16 corresponding to each tableau space 12. The random sequence may be a row, column, or stack, or other shape. If a stack is used, the endmost card is the topmost card. The letters available for play are the endmost letters 14 of each sequence 16. The object of the game is to form words using letters 14. This is done by rearranging the endmost letters 14 of the sequences 16. Possible moves are governed by the following rules for general play:

1. Words or beginning of words are formed by the endmost letters 14 of each sequence 16 such that the last letter 14 of the sequence 16 is the last letter of the word or the last letter of the beginning of the word.

2. The endmost letter 14 of a sequence may be moved onto the endmost letter 14 of another sequence 16 if a word or the beginning of a word is formed on the other sequence 16. For example, suppose the letter Q is to be moved into a sequence where the only other letter is X. If the word list (if one is used) does not contain any words that contain the letter arrangement XQ then it would be an illegal move. In another example suppose the letter E is to be moved to a sequence that contains the letters AX. If the word list contained the letter arrangement AXE as either a complete word or as the beginning of a word then the move would be valid.

3. More than one of the endmost letters 14 may be moved onto the endmost letter 14 of another sequence 16 if the endmost letters 14 already form the beginning of a word, or if a word or the beginning of a word is formed on the other sequence 16. In other words, groups of letters 14 may be moved as long as they are complete words, or part of another word. For example in a sequence containing OAED, either D, ED, or AED may be moved; E, or AE or OAE alone may not be moved. The group may be placed into another sequence as the last set of letters in the sequence and it must form a valid word or beginning of a word with the letters already in that sequence. Suppose a word list contains the two entries ARMED and HARMED and an initial layout has 3 sequences, each with a capacity of 8 letter tiles and containing: OAEDRM, HA, and an empty tableau space; in such a case RM from OAEDRM may be placed at the end of HA forming HARM because HARM is also the beginning of the word HARMED. In the second iteration we would have: OAED, HARM, and still an empty tableau space. Now ED may be placed at the end of HARM to form HARMED which is a valid word. ARMED from the second sequence containing HARMED may now be moved to the third sequence which is empty leaving: OA, H, and ARIVIED in the three sequences. At this stage another move can be made based on a rule configuration. In one rule set the word ARMED may now be moved to the end of OA or H because ARMED itself is a complete word (this would be valid even if ARMED was only the beginning of another word). In another rule set moving completed words or beginning of words to the end of a sequence will only work if the group of letters being dropped form a new word or beginning of a word with the tail end of the letters already in the sequence. This rule can be offered to the player as an option or may be predetermined by the game mode itself.

4. Words formed from the endmost letters 14 of the sequences 16 are removed from the sequence 16.

Figure 5:
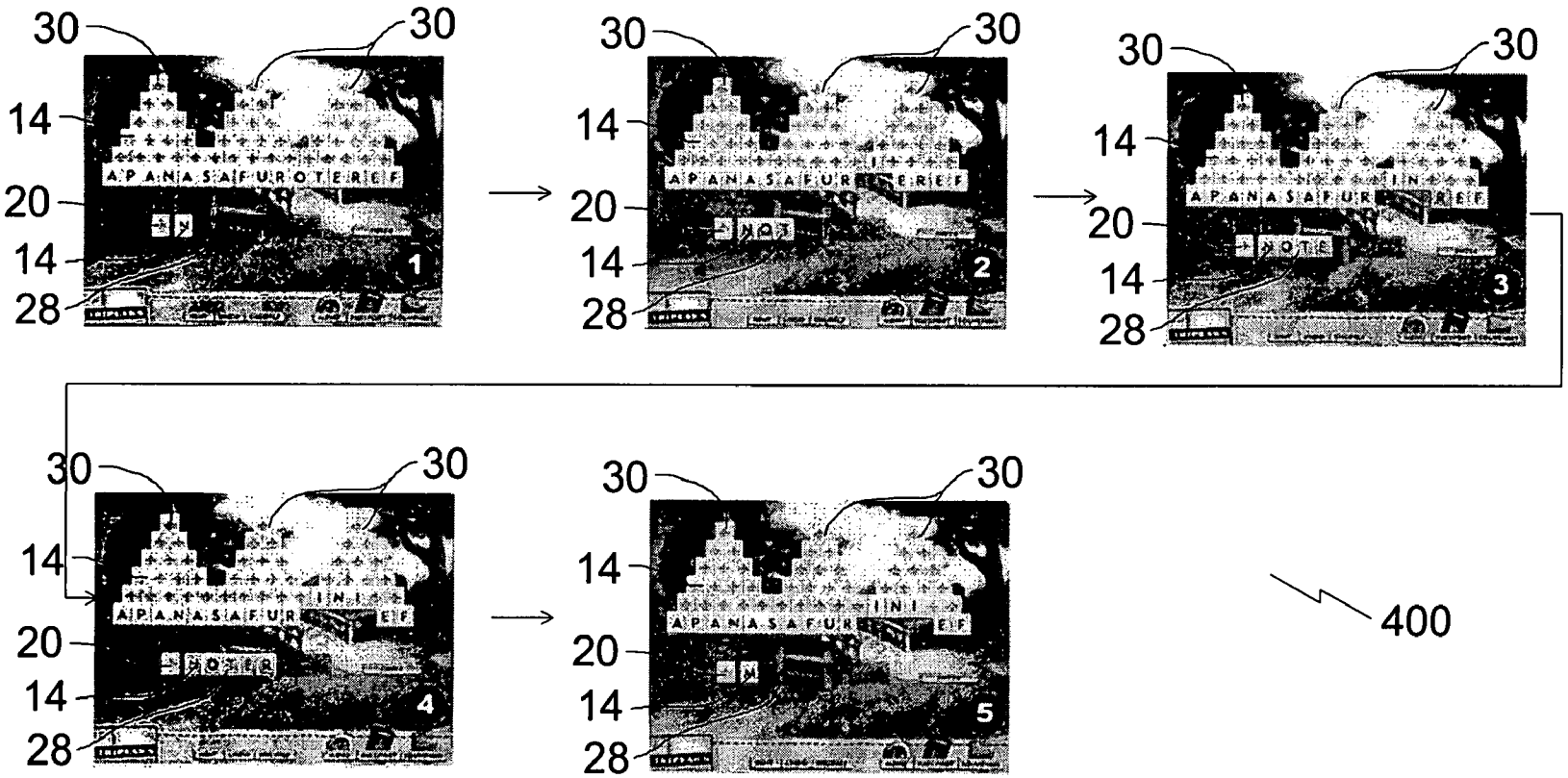
FIG. 5 is a tripeaks solitaire style layout of the letter card game and an example of a sequence of moves made during a game.

It will be understood that these rules are the basic rules, and may be modified slightly, or other rules may be added to provide variations in play. Some of these variations include:

1. Referring to FIG. 5, the endmost letters 14 in each sequence 16 are oriented face up and the remaining letters 14 are oriented face down. The face down cards 14 are then oriented face up when each of the face up letters 14 in the sequence 16 is moved to another sequence 16.

Figure 2A:
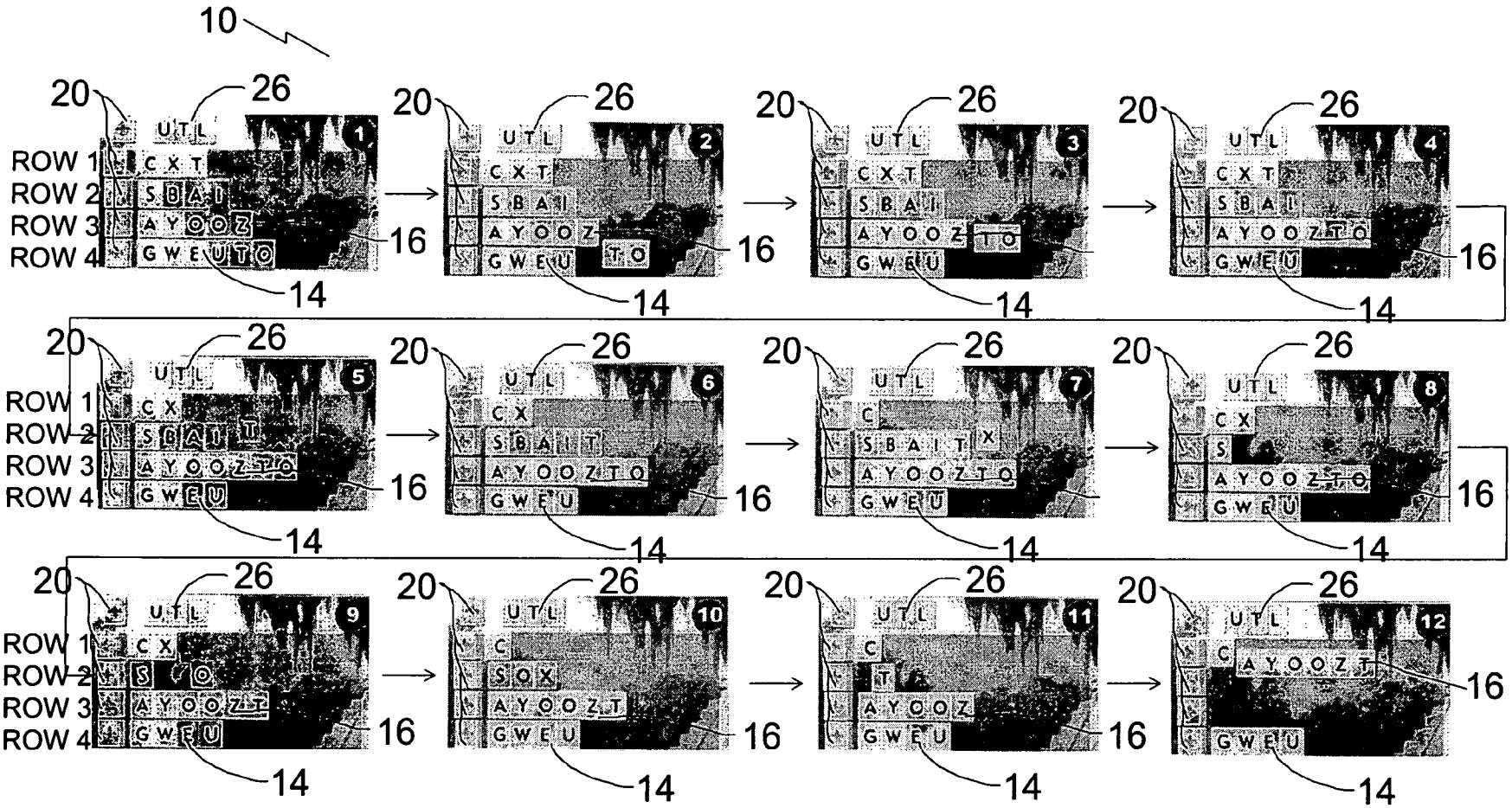
FIGS. 2A and 2B is an example of a sequence of moves made during a game.
Figure 2B:
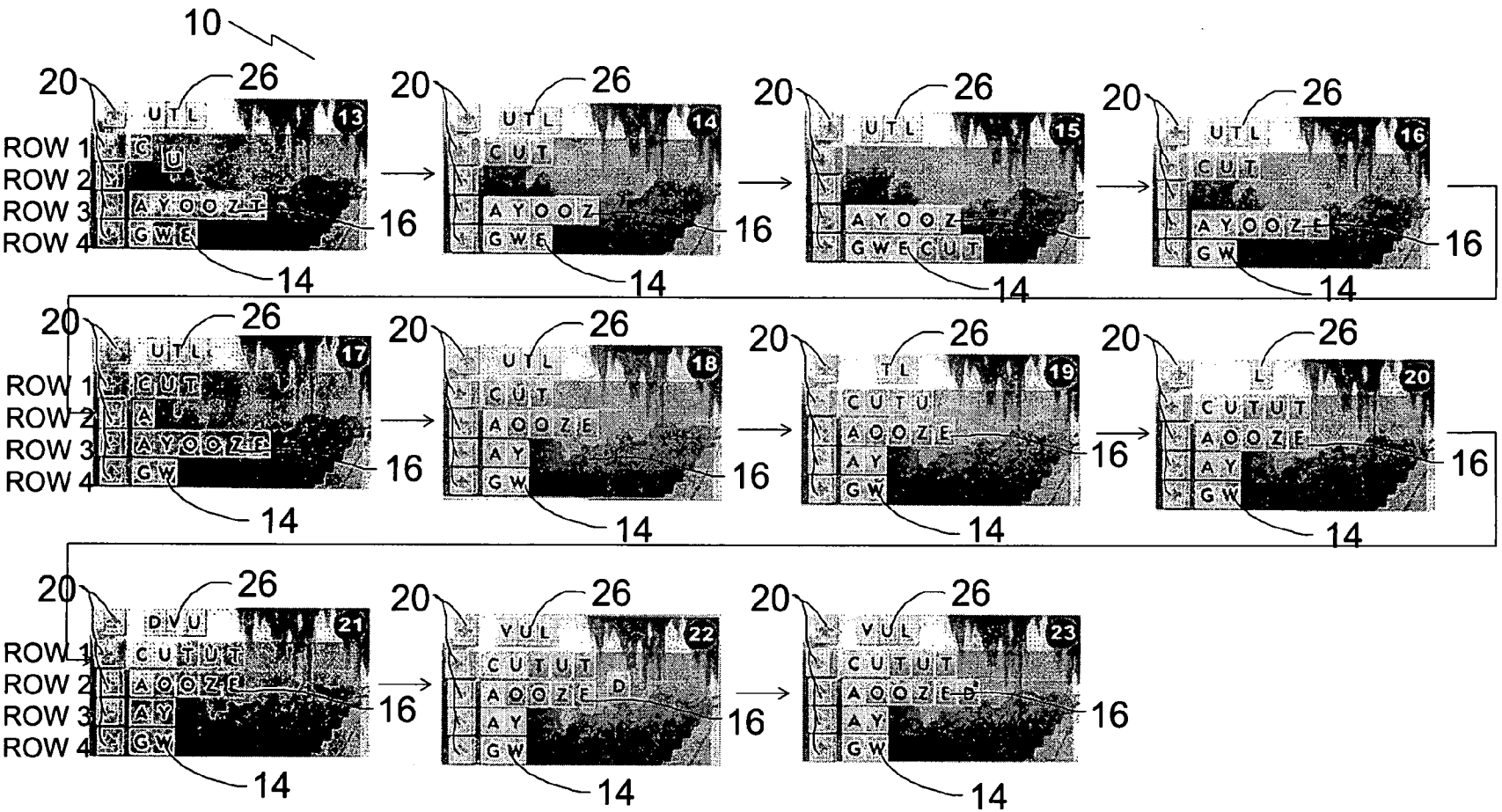

2. Referring to FIGS. 2A and 2B, empty tableau spaces 12 may be filled by the endmost letters 14 of different sequences 16.

3. Groups of letters 14 may only be moved if they form a word or the beginning of a word with the endmost letter 14 of the other sequence 16.

Figure 4:
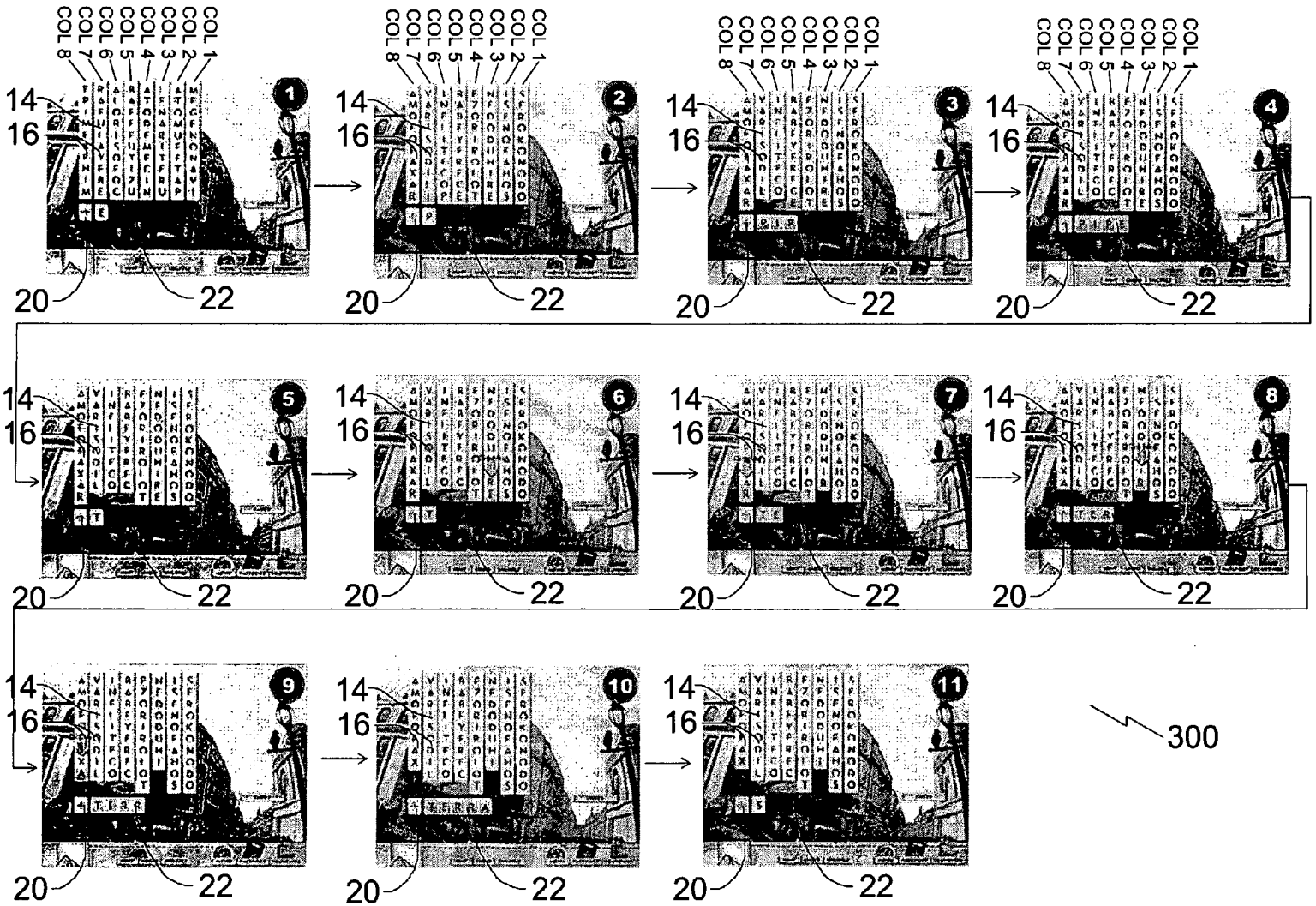
FIG. 4 is a golf solitaire layout style layout of the letter card game and an example of a sequence of moves made during a game.

4. Referring to FIG. 4, stock spaces 22 are provided that may be filled by endmost letters 14: either one letter, or the beginning of a word.

5. Referring to FIG. 1, each sequence 16 may be made up of a different number of cards at the beginning.

Figure 3:
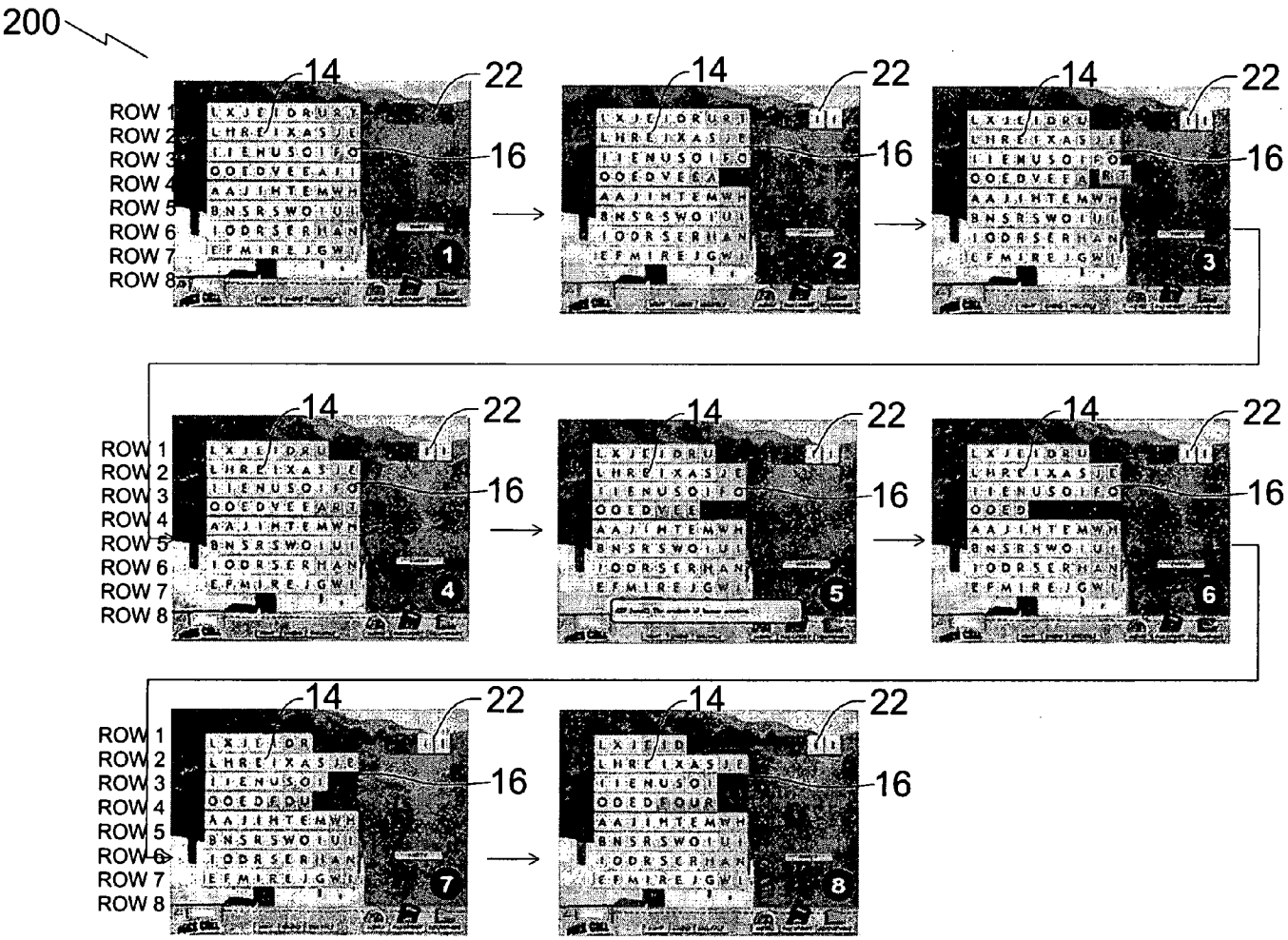
FIG. 3 is a freecell solitaire style layout of the letter card game and an example of a sequence of moves made during a game.

6. Referring to FIG. 3, each sequence may be limited to a maximum number of letters, such that an endmost card may not be moved to a sequence that has reached that maximum number of letters.

7. Referring to FIG. 1, a reserve of letters or foundation 26 may be provided, wherein letters 14 from the reserve of letters 26 may be placed on the endmost letter 14 of a sequence 16 to form a word or the beginning of a word.

8. Points are scored based on the letters used to form a word, such that the longer the word, or the more uncommon the letters (e.g. q, z), the more points are awarded.

9. The game may be played by a single player, or more than one players (preferably no more than two). In the multi-player game, players take turns moving cards, and points are scored according to the words formed.

10. The game may allow words in one or more languages.

11. The game may be played with letters printed on cards or tiles, or on a computer.

12. The difficulty of the game may be adjusted by changing the following features: the number of allowable words, the length of allowable words, the type of allowable words, and the conditions of allowing hints (in the computer version).

The initial seeding of the letters in any layout is generated based on a frequency table of the language the game is being played in. The frequency table (not shown) is representative of how common a letter is in that language. For example, in the English edition the letter Q would have a much lower frequency then the vowels A, E, I, O, and U, and as such would only appear on rare occasions. If layout called for 12 letters and the alphabet/frequency was of A/1, M/3, E/2 the game would contain 2 A's, 6 M's, and 4 E's.

Once words are formed, a player may elect to score them. When a player elects to score words the letters forming the word are removed from the layout and discarded and a score tally is calculated. The score is the sum of the individual scores of each tile. Bonuses in the form of score multipliers may be awarded if the player completes a word in a specific time, creates a certain length of word, or scores more than one word during a turn.

The game is over if the player manages to clear the entire set of letters by forming valid words, no valid words can be formed with the remaining letters, or no valid moves exist. A bonus score may be awarded if the player manages to clear the entire set of letters. Once the game is over the player with the highest score wins the game.

In the computer edition of the game, certain clues are provided that aid the player in forming words that may not be in their vocabulary. These clues consist of highlighting, through a combination of special effects, graphics, and audible sounds, groups of letters that form prefixes or words. For example, when the player attempts to make a move, the color of the letters being moved and the colors of the letters in the row where the letters will be placed are changed to indicate a valid prefix or word being formed. This allows the player to experiment by moving non common letters together to see if they may result in a word. Another useful item is an automatic word solver. This is an artificial intelligence program that looks at the layout and gives tips to the player on the best move to make in order to maximize their score or complete the game. These clues can be turned on or off by the player depending on how easy or difficult of a game experience they want. Clues may also carry a penalty. For example, using a hint may deduct points from the players score. Clues are calculated by using an algorithm that searches through all words in a word list and compares them to the letters in the layout. Any matching prefixes or words that are found can then be put into a highlighting state.

Figure 7:
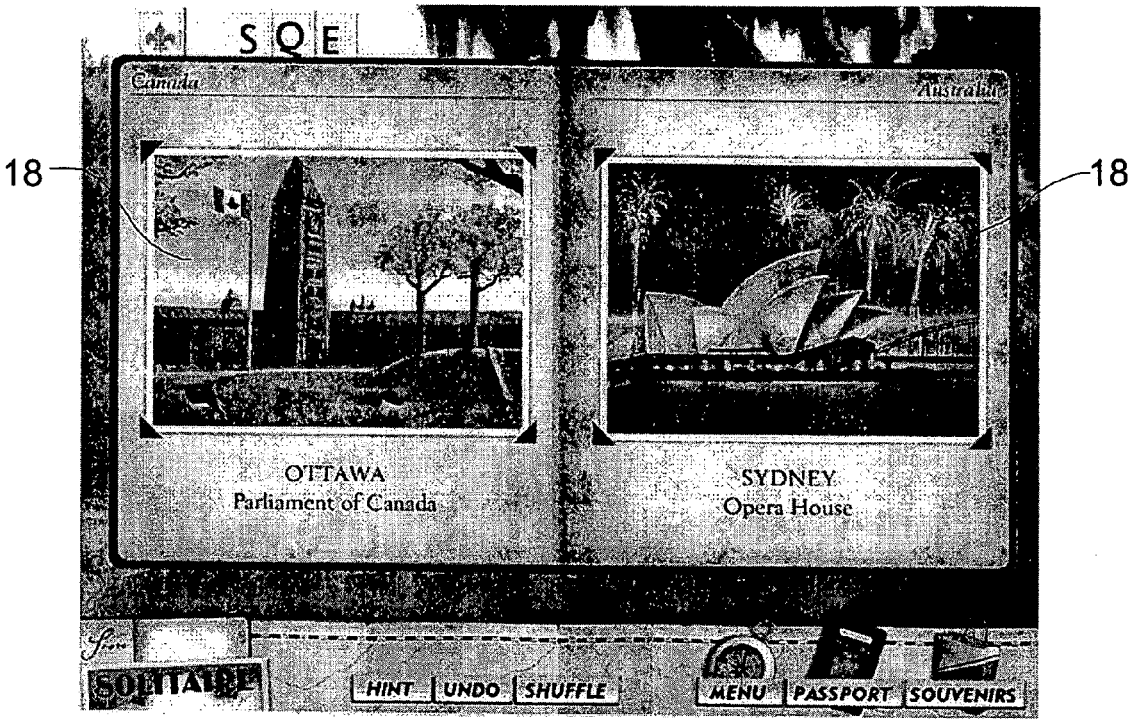
FIG. 7 is a screen layout for a computerized version of the game.

An example of the opening screen layout for the computer edition of the game is shown in FIG. 7. Players may be awarded rankings and virtual prizes based on their performance at the end of a game. In this particular implementation the game features a traveling theme in which the player is attempting to journey across the world. As the player progresses through games their score is tied to a travel meter (not shown); the travel meter shows their current location and how far away they are from their next destination. After certain milestones, for example scores of 5,000, 10,000, and 25,000, are achieved the player is awarded a postcard or photo 18 from the current country they are visiting. Once the player has completed their collection in a country they are transported to a new country. If a player passes all the countries in the game they are brought back to the first country and the cycle continues. Their total rank is based on the number of postcards they have collected from the various countries. The rank could be a symbol or value that indicates to the player their overall performance in the game. The rank may be a meter or value from 0 to 100 that represents their overall performance in the game and it may also be accompanied with icons, for example: a rank of 0 would show a pair of shoes and state "You walk around", a rank of 25 would show a motorbike and state "Two wheel adventures!", and a rank of 100 could show a Lear jet and state "World Class Traveler! You get there with speed and style."

Along with the ranking progression, players may be awarded virtual "trip miles" based on their score at the end of each game. The trip miles are based on their score, for example 1 trip mile may be awarded for every 10,000 points earned. These trip miles can then be cashed in for virtual prizes in the game. Virtual prizes included graphical souvenirs, new graphics or themes, and new sounds. These items can be unlocked through a purchasing mechanism whereby the player spends a certain amount of their trip miles for a certain item. These items can also expand on the virtual prize theme by offering players enhancements or aids within the game. One such example would be unlimited hints for a particular round of a game.

Other variations will be apparent from the examples given below.

EXAMPLE 1

FIGS. 2A and 2B represents a sequence of moves that showcase the general play mechanic in a game 10. The moves progress as follows:

1—An initial layout consisting of 5 stock piles 20 of cards 14 and 5 rows 16. The top row 26 contains space for 3 cards 14 and is fed from the stock pile 20 to the left of it, we shall call this the foundation 26. Only the top most card 14 in this row may be picked up as it covers those underneath it. Below the foundation 26 are rows 16, labeled row 1 through row 4, with stock piles 20 to the left of them. All the letters 14 in these rows 16 are side by side and can be moved. The beginning of words are shaded and complete words are shaded darker. All stock piles 20 contain letter cards 14 that are face down.

2—TO is picked up. This is a legal move because TO is a word and the beginning of other words, such as TOMORROW.

3—TO is moved to the 3rd row, at the end of AYOOZ. OOZ is no longer highlighted as the beginning of a word now because if TO was to be dropped here it will not form a new word or beginning of a word. TO remains highlighted because it is still the beginning of a word.

4—TO is dropped into row 3 and is the lone beginning of a word in this row.

5—T is picked up from row 1 and is placed over row 2. This highlights BAI and T in blue as it will form a completed word if T is dropped here.

6—is dropped into row 2 to form BAIT.

7—X is attempted to be placed in front of BAIT. Since this does not form a valid beginning of a word or word it is an illegal move and as such the highlighting is removed from BAIT.

8—X is placed back in row 1 and BAIT is scored. The letter tiles BAIT are then removed from the playfield.

9—0 is moved from the end of row 3 and moved over row 2. Since S and 0 are the beginning of a word, such as SOCKS, both the letter tiles are highlighted. In the 3rd row no letters are highlighted because there are no words or beginning of words.

10—X is dropped from row 1 to form SOX

11—SOX is scored and removed. T is moved from row 3 over row 2. This is an invalid move because a deck is still feeding into row 2 from the left.

12—T is return to row 3. AYOOZT is now picked up and attempted to be placed into row 1. Since AYOOZT is not the beginning of the word and does not form a word or beginning with the letter C this is an illegal move.

13—U is moved from row 4 over row 1. Since C and U form the beginning of a word they are highlighted. WE in row 4 is highlighted because it is the beginning of a longer word, such as WET.

14—T is moved from row 3 to row 1, forming the word CUT. OOZ in row 3 is now highlighted because it forms the beginning of a word, such as OOZE.

15—CUT is moved to row 4. This is a legal move because CUT is a word or the beginning of another word; as such it can be placed in at the end of any row containing letters.

16—Suppose CUT was not moved and left in row 1, as depicted in diagram 14. Instead the letter E from row 4 is dropped into row 3 to form the word OOZE.

17—A letter tile from deck 2 is fed into row 2, the card is flipped over and is revealed to be the letter A.

18—OOZE is moved from row 3 to row 2.

19—U is moved from the foundation row to row 1. This forms the beginning of a longer word and is highlighted as such. Only U may be moved from the foundation row at this time because it is covering up the letters T and L.

20—T is moved from the foundation row to row 1. This forms the word TUT.

21—The foundation deck is activated and the next 3 cards are drawn from it: D, V, and U. These letters are overlaid on the letter L which disappears.

22—D is moved from the foundation over row 2, this highlights the letter D because if it is dropped into row 2 it will form the word OOZED. The foundation row also reveals the letters V, U, and L. The L has reappeared because it was the letter covered up by D, V, and U.

23—D is dropped into row 2 to form the word OOZED.

EXAMPLE 2

Referring to FIG. 1, a klondike solitaire layout 100 is used. A top most deck card 14 feeds into a row 16 that has enough space for 3 cards (only the top most card from this row may be picked up). In an alternative version this may be changed to a single card. There are 8 rows 16 that players may use to assemble words in. Each of these rows 16 has a stock 20 of cards 14 tied into it that vary in number. The game is complete once all letters are used up or no valid moves are possible.

EXAMPLE 3

Referring to FIG. 3, a freecell solitaire layout 200 is used. Stock spaces 22, with space for four cards is provided in this layout. These are temporary holding cells in which letter tiles 14 may be placed, although words may not be formed here. There are also eight rows 16 that players may use to assemble words in; none of the rows 16 have stocks 20 associated with them. The row length is may be variable, with a default length of 10 letters. An example of how the game may progress is as follows:

1—Initial Layout.

2—I and I are moved from row 4 to the holding cells

3—RT from row 1 is moved over row 4 which highlights the word ART

4—RT is dropped into row 4 and forms ART which is then scored

5—VEE is now automatically formed in row 4

6—VEE is scored

6—OF is moved from row 3 to row 4 and U from row 1 is moved to row 4, forming FOU 7—R is moved from row 1 to row 4 to form FOUR

EXAMPLE 4

Referring to FIG. 4, a golf solitaire layout 300 is used. The layout consists of 8 vertical rows 16 of cards 14. Only the bottom most card 14 may be played as it covers those above it and words may not be formed in these. There is also a horizontal row 28 which is tied to a stock pile 20 that feeds cards into it, and in which words are formed. The row 28 in which words are formed always contains an initial letter 14 from the stock 20. This letter 14 must be used in forming a word. The game is over once all the letter rows 16 are cleared, no words can be formed, or the stock 20 feeding into the word forming row 28 runs out of cards. An example of how the game may progress is as follows:

1—Initial Layout, initial letter is E from the stock 20.

2—I is highlighted in column 2 as it will form the beginning of a word when moved in front of P 3—I and P are brought down from columns 2 and 3 to form the word PIP, E from column 4 is highlighted because it will form the word PIPE if brought down. When I and P are brought down they open up the letters they were covering in their columns (L and 0)

4—PIPE is scored

5—A new letter 14, T, from the stock 20 is automatically placed in the word forming row 28

6/7/8/9/10—Game play continues as normal as the word TERRA is formed

11—TERRA is scored and a new letter 14 from the stock 20 is automatically placed in the word forming row 28.

EXAMPLE 5

Referring to FIG. 5, a tripeaks solitaire layout 400 is used. The layout consists of letter cards 14 laid out in a shape such that they form 3 pyramid sequences 30 instead of a linear sequence 16 as in the other games. Letters 14 at the very bottom (those not covered below by any other letter card) are face up while the rest are face down. Letters 14 face down may not be used in forming words. The horizontal row 28 at the bottom is the word forming row. This row 28 is tied to a stock 20 and always contains an initial letter 14 from the stock 20. This initial letter 14 must be used when forming a word. The game is over once all letters 14 in the pyramid 400 are cleared, no words can be formed, or the stock 20 feeding into the word forming row 28 runs out of cards. An example of how the game may progress is as follows:

1—Initial Layout, initial letter 14 from the deck is N

2—0 and T are moved from the pyramids to form NOT, this opens up the letter I

3—E is moved to form the word NOTE, R is highlighted as it will form a longer word if brought down. N is also flipped up because no letter tile 14 is covering it 4—R is brought down and forms NOTER. This opens up another letter I 5—NOTER is scored and a new letter 14, M, is drawn from the stock 20

EXAMPLE 6

Figure 6:
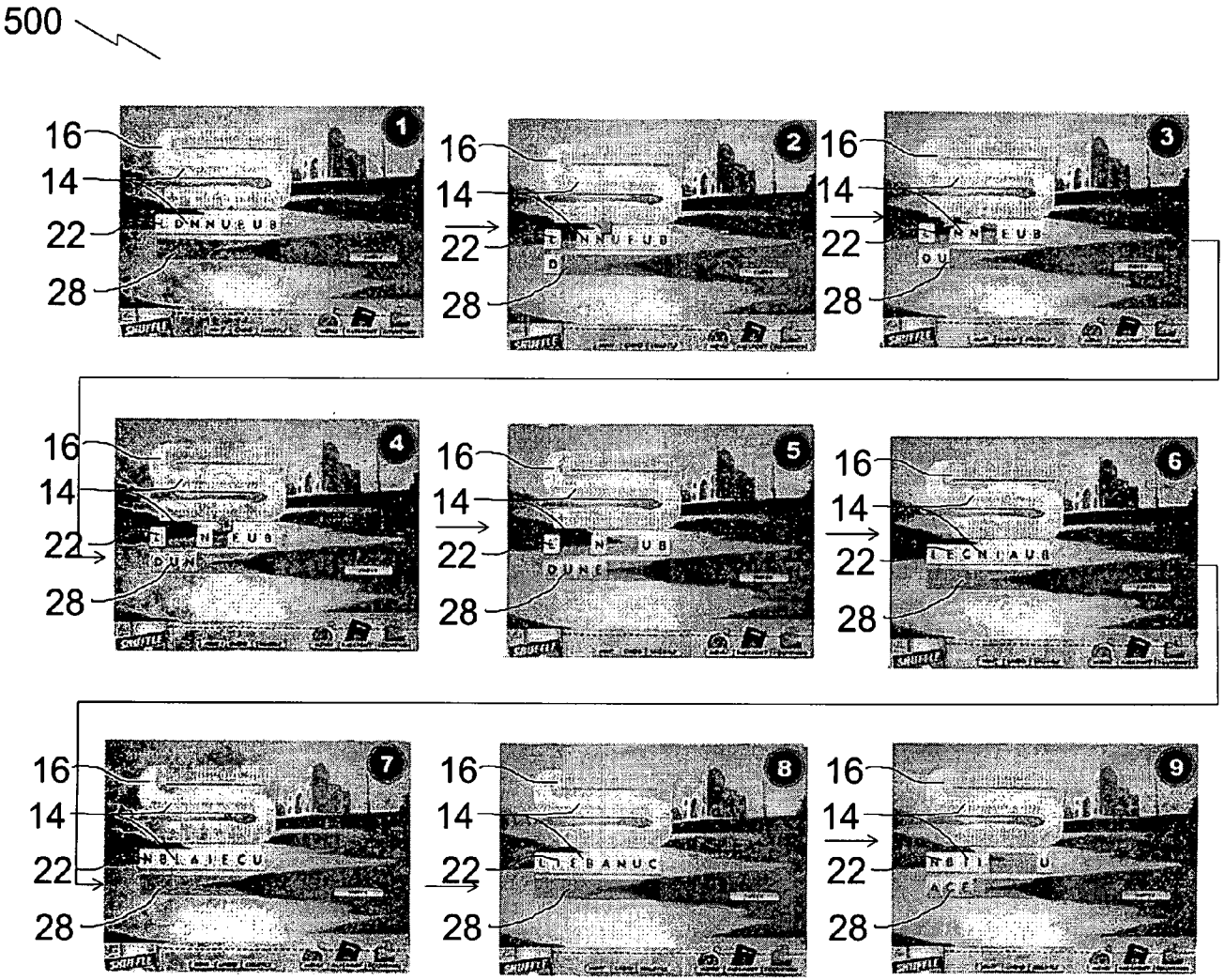
FIG. 6 is a shuffle solitaire style layout of the letter card game and an example of a sequence of moves made during a game.

Referring to FIG. 6, a shuffle solitaire layout 500 is used. The layout consists of cards 14 fanned out in a shape such that they form a path 16 (an S-shape in this case). All of these cards 14 are face down. Below this is a row of stock spaces 22 in which the top most 8 cards from the path 16, all face up, are laid out, and, below that is a word forming row 28. The game is over once all the cards in the path 16 are used up or no new words can be formed. An example of how the game may progress is as follows:

1—Initial Layout, initial letters from the path 16 are LDNNUEUB

2—D is brought down to the word forming row 28

3—U is brought down.

4—N is brought down, this forms the word DUN

5—E is brought down, forming DUNE

6—DUNE is scored and 4 new letters 14 are. removed from the path 16 and fill in the missing letter spots. The new letters are LECNIAUB 7/8—A game aid, SHUFFLE, may be used in the computer version which simply shuffles around the letters LECNIAUB to NBLAIEC then to LIEBANUC 9—A, C, and E are brought down to from ACE. Shuffle is hit again and shuffles LIBNU to NBILU. Note that shuffle does not touch cards 14 that the player is current using to form a word with.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope defined in the Claims.

What is claimed is:

1. A method of playing a word game comprising the steps of:

(a) providing more than one grouping of tableau spaces;

(b) placing letters arranged in a random sequence in each grouping of tableau spaces, each random sequence having an end with a last letter positioned at the end and endmost letters, including the last letter, positioned toward the end;

(c) moving one of the last letter or the endmost letters of one random sequence to the end of an other random sequence, where a word or a part of a word is formed by one of the last letter or the endmost letters of the one random sequence being moved and added to one of the last letter or the endmost letters;

(d) removing from the grouping of tableau spaces of the other random sequence the word formed as a result of moving one of the last letter or the endmost letters to the other random sequence; and (e) repeating steps (c) and (d).

2. The method of claim 1, further comprising the step of placing the letters in each random sequence face down except for the endmost letters which are placed face up.

3. The method of claim 2, further comprising the step of sequentially turning the face down letters face up as the face up letters are removed from each random sequence, with a last of the face down letters being first to be turned face up.

4. The method of claim 1, further comprising the step of moving the last letter or the endmost letters from a selected random sequence to fill empty tableau spaces resulting from the word being removed from the grouping of tableau spaces.

5. The method of claim 1, further comprising the step of providing at least one stock space in each grouping of tableau spaces and moving the last letter of one of the random sequences to fill the at least one stock space.

6. The method of claim 1, further comprising the step of providing groupings of tableau spaces that vary in size and capacity to accommodate letters, and movement of the last letter or the endmost letters being limited by the capacity of the groupings of tableau spaces to accommodate more letters.

7. The method of claim 1, further comprising the step of providing a reserve of letters, and moving one or more of the reserve of letters where a word or a part of a word is formed by one or more of the reserve letter being moved and added to one of the last letter or the endmost letters of one of the other random sequences.

8. The method of claim 1, further comprising the step of having two players play the word game, with the two players taking alternating turns to move letters.

9. The method of claim 1, further comprising the step of placing the letters on manually manipulated cards or tiles.

10. The method of claim 1, further comprising the step of placing manipulating the letters on a computer screen.

11. The method of claim 1, further comprising the step of scoring points based on the word that is formed.

12. The method of claim 1, further comprising the step of adjusting a degree of difficulty of the game by limiting allowable words.

13. A method of playing a word game, the method comprising the steps of:

(a) providing a plurality of grouping of tableau spaces;

(b) placing letters, arranged in a random sequence, in each of the plurality of tableau spaces, with each random sequence ending with plurality of endmost letters which are located at an end of the random sequence;

(c) moving one of a last letter or a group of endmost letters of one of the random sequence to the end of another random sequence only when a word, or a part of a word, is formed by one of the last letter or the group of endmost letters of the one random sequence being moved and added to one of the last letter or the group of endmost letters of the other random sequence;

(d) removing from the grouping of tableau spaces of the other random sequence the word formed as a result of moving one of the last letter or the group of endmost letters to the other random sequence; and (e) repeating steps the moving and the removing steps until no other words may be formed; and (f) determining a score based upon the number of words formed while playing the word game.

* * * * *